US012352166B2

(12) United States Patent
Launis et al.

(10) Patent No.: US 12,352,166 B2
(45) Date of Patent: Jul. 8, 2025

(54) APPARATUS, DRILLING ARRANGEMENT AND METHOD FOR HIGH VOLTAGE ELECTRO PULSE DRILLING

(71) Applicant: SANDVIK MINING AND CONSTRUCTION OY, Tampere (FI)

(72) Inventors: Sirpa Launis, Tampere (FI); Jukka-Pekka Uusitalo, Tampere (FI); Jenni Rekola, Tampere (FI); Matthias Voigt, Tampere (FI); Erik Anders, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/575,033

(22) PCT Filed: Jun. 30, 2022

(86) PCT No.: PCT/EP2022/068081
§ 371 (c)(1),
(2) Date: Dec. 28, 2023

(87) PCT Pub. No.: WO2023/275261
PCT Pub. Date: Jan. 5, 2023

(65) Prior Publication Data

US 2024/0295148 A1 Sep. 5, 2024

(30) Foreign Application Priority Data

Jul. 2, 2021 (EP) ..... 21183403

(51) Int. Cl.
*E21B 7/15* (2006.01)
*E21B 21/08* (2006.01)

(52) U.S. Cl.
CPC ..... *E21B 7/15* (2013.01); *E21B 21/08* (2013.01)

(58) Field of Classification Search
CPC ..... E21B 7/15; E21B 21/08
See application file for complete search history.

(56) References Cited

U.S. PATENT DOCUMENTS

| | | | | |
|---|---|---|---|---|
| 3,506,076 | A * | 4/1970 | Angona | H02N 2/186 175/57 |
| 4,741,405 | A * | 5/1988 | Moeny | E21B 7/007 175/16 |
| 5,896,938 | A * | 4/1999 | Moeny | E21B 7/15 175/16 |
| 2006/0037779 | A1 | 2/2006 | Moeny et al. | |
| 2009/0050371 | A1 | 2/2009 | Moeny | |
| 2011/0290563 | A1 * | 12/2011 | Kocis | E21B 7/14 175/57 |

(Continued)

FOREIGN PATENT DOCUMENTS

| | | |
|---|---|---|
| CA | 2896335 A1 | 6/2014 |
| EP | 1789652 A2 | 5/2007 |

*Primary Examiner* — Yanick A Akaragwe
(74) *Attorney, Agent, or Firm* — Corinne R. Gorski

(57) ABSTRACT

An apparatus, drilling arrangement and method for high voltage electro pulse drilling of rock. The apparatus includes a switch having two electrodes spaced at a distance from each other. The switch is located in connection with a drilling tool. The switch may be surrounded by a chamber, which prevents flushing fluid entering between a switch gap of the electrodes.

11 Claims, 5 Drawing Sheets

(56) References Cited

U.S. PATENT DOCUMENTS

| | | | | |
|---|---|---|---|---|
| 2013/0032400 | A1* | 2/2013 | Dirksen | E21B 36/001 175/17 |
| 2017/0067292 | A1* | 3/2017 | Bayol | E21B 41/0085 |
| 2022/0065106 | A1* | 3/2022 | Rowe | E21B 7/15 |
| 2023/0145343 | A1* | 5/2023 | Finke | E21B 41/0085 175/57 |

* cited by examiner

APPARATUS, DRILLING ARRANGEMENT AND METHOD FOR HIGH VOLTAGE ELECTRO PULSE DRILLING

RELATED APPLICATION DATA

This application is a § 371 National Stage Application of PCT International Application No. PCT/EP2022/068081 filed Jun. 30, 2022 with priority to EP 21183403.1 filed Jul. 2, 2021.

BACKGROUND OF THE INVENTION

The invention relates to an apparatus for a high voltage electro pulse rock drilling wherein drill holes are formed by means of high voltage electro pulses conveyed through rock material.

The invention further relates to a drilling arrangement and method for a high voltage electro pulse rock drilling.

In mines and at other work sites different type of rock drilling systems are used for drilling drill holes to rock surfaces. Conventionally the drill holes are drilled by means of mechanical drilling systems utilizing rotation of drill bits which mechanically break and remove rock material. The systems may also implement impacts for improving the mechanical rock removal. In addition to the mechanical drilling, different type of electrical drilling methods has been developed. One of them is a high voltage electro pulse rock drilling wherein the drill holes are formed by means of high voltage electro pulses conveyed through the rock material to be drilled. However, the known solutions for the high voltage electro pulse rock drilling have shown some disadvantages especially when they are implemented in practice at work sites.

BRIEF DESCRIPTION OF THE INVENTION

An object of the invention is to provide a novel and improved apparatus, drilling arrangement and method for a high voltage electro pulse rock drilling.

An idea of the disclosed solution is that the high voltage electro pulse drilling arrangement or system comprises a drilling tool comprising one or more drill tubes between a pulse generator generating high voltage electro pulses and a drill head which directs the generated electro pulses to the rock material. The drilling tool is provided with a switch comprising a switch gap in a supply line of the high voltage electro pulses. The switch gap may also be called as a pre spark gap since an electric breakdown occurs therein before occurring between electrodes of the drill head, i.e. in a main spark gap, and thereby causing the actual destroy for the rock material at the bottom of a drill hole. In the disclosed solution, the switch is located inside the drill hole during the drilling.

The switch of the drilling tool is provided with two opposing electrodes located at a distance from each other for forming the switch gap between them. There is a first terminal and a second terminal for connecting the switch to a high voltage conductor being part of the electrical supply line. The switch is provided with a shielding or protection so that flushing fluid utilized in the rock drill cannot enter to the pre spark gap.

An advantage of the disclosed solution is that the disclosed drilling tool mounted switch allows the pulse generator, which initially generates the pulses, to be at a long distance from the drill head, and still effective high voltage electro pulses can be produced for destroying the rock material. In other words, the aim of the switch is to boost the high voltage electro pulses by accelerating them to be fast enough to enable efficient electro pulse rock drilling.

The tool mounted switch may also allow more free and versatile design options for the drilling arrangement and the entire system.

Efficient rock drilling requires also efficient flushing of removed rock material. The switch is located in connection with the drill tool wherein the flushing fluid flows during the drilling. Since the switch gap of the switch is protected against penetration of the flow of the flushing fluid, the switch can operate as designed and can produce effective pulses for the drill head.

Rock detaching efficiency is not limited by drilling depth since the switch gap adjacent the drill head boosts the high voltage pulses. In other words, the increased length between the pulse generator and the drill head can be compensated by selecting suitable switch or adjusting its parameters.

Further, the high voltage electro pulse rock drilling has several general advantages compared to the conventional mechanical drilling. In the electro pulse drilling the rock is destroyed without a need for significant mechanical forces, which drastically reduces wear on the drilling tool and increases service life of all drilling components. Due to achieved high energy efficiency and shorter drilling time overall price of the drilling process can be decreased.

According to an embodiment, the switch gap of the switch provides the electro pulses with a shorter rise time. The electro pulses with the shorter rise time are quicker and can destroy the rock material more effectively as compared to slower pulses.

According to an embodiment, the apparatus is configured to provide a drilling arrangement with a so called pre spark gap as close as possible to a drill head which is located at a distal end of a drilling tool. This way, the pulse generator, which is located outside the drill hole being drilled, can be located at a relatively long distance from the drill head which does the actual removal of the rock material at the bottom of the drill hole. Due to length of the drilling tool, electro pulses, generated by the pulse generator and directed to the drilling tool, may be weakened so that no effective rock breaking can be done at the bottom of the drill hole. The electro pulses need to have certain properties in order them to penetrate properly inside the rock material being drilled. Length of the drilling tool may be several meters, and further, distance between the pulse generator, which may located on a carrier of rock drilling rig, and the drilling tool may also be several meters because of booms etc., whereby total distance between the pulse generator and the drill head is great. Despite of the mentioned several meters, for example 4-10 m, effective drilling is achieved. When the pulse generator is located outside the drill hole, the pulse generator may be designed and dimensioned more freely and to be more powerful when compared to situation wherein the pulse generator is located inside the drill hole.

According to an embodiment, the drilling tool is provided with an apparatus comprising the mentioned switch surrounded by a chamber or casing for preventing the flushing fluid entering between the spark gap. The chamber may be hermetically sealed. In other words, the sealed chamber isolates an inner space of the chamber from fluids surrounding the apparatus. When the chamber is gas and liquid tight, then the flushing fluid cannot enter to the switch gap and diminish its effect. The apparatus further comprises mechanical coupling elements for connecting the apparatus to the drilling tool. The coupling elements may comprise different connecting surfaces and supporting elements.

According to an embodiment, the sealed chamber is pressurized with gas.

According to an embodiment, properties of the switch can be affected by selecting desired filling gas and pressure inside the space surrounding the switch gap.

According to an embodiment, pressure of the gas inside the chamber is at least 1.1 bar.

According to an embodiment, pressure of the gas inside the chamber is at least 2 bar.

According to an embodiment, pressure of the gas inside the chamber is at least 5 bar.

According to an embodiment, high pressure of filling gas is implemented inside the chamber. The pressure can be at least 10 bar. The pressure may be up 25 bar, or even more, for example.

According to an embodiment, there may alternatively be a vacuum inside the chamber, or inside any other space surrounding the spark gap.

According to an embodiment, the apparatus comprises at least one feed port for adjusting gas pressure prevailing inside the chamber. In other words, the properties of the switch can be adjusted by adjusting the gas pressure.

According to an embodiment, the gas pressure can be adjusted remotely and online during the rock drilling process. The gas pressure surrounding the switch may be one actively controlled drilling parameter. In this embodiment the rock drilling tool is provided with a gas pressure channel connecting the feed port of the apparatus to a gas adjusting device which is located outside the drill hole. The gas pressure channel may be a tube, hose, or any other path for providing the needed connection for the flow of adjusting gas.

According to an embodiment, there may be selectable apparatuses with different filling gases and gas pressures inside their chambers whereby desired apparatuses suitable for each drilling situation can be selected by means of an operator at least when initiating the drilling process of a drill hole. In other words, a set of different apparatuses with different gas pressure features can be made available.

According to an embodiment, the usage of as high pressure of gas as possible inside the chamber, or at least surrounding the spark gap of the switch, is advantageous in respect to effectiveness of electro pulses directed to the rock material. Breakdown voltage between the electrodes of the switch increases in response to increase of the gas pressure inside the chamber. With the higher gas pressure, the breakdown voltage increases and faster risetime of the electro pulse is produced compared to lower gas pressure situation. When drilling softer rock material lower gas pressure can be applied and when drilling harder rock then higher gas pressure can be applied.

According to an embodiment, the distance between the opposing electrodes of the switch can be adjusted for adjusting magnitude of the switch gap. In other words, the properties of the enhanced pulses can be adjusted by adjusting the magnitude of the switch gap. Greater switch gap means higher voltage need for the breakdown and more effective electro pulse for penetrating inside the rock material. The magnitude of the switch gap is one adjustable drilling parameter in the disclosed electro pulse rock drilling.

According to an embodiment, the switch gap is pre-adjusted before the apparatus is mounted to the rock drilling tool. There may be a set of different apparatuses with different switch gaps and the operator can select suitable apparatus for each drilling situation. The switch gap may be adjusted by means of mechanical means, such as screws or wedges, for example.

According to an embodiment, the switch gap is remotely adjustable when being mounted to the rock drilling tool. There may be one or more adjusting actuators in connection with the apparatus. The actuators may be electrically operable, or they may be pressure medium operated actuators, for example.

According to an embodiment, the apparatus comprises at least one sensor or sensing device for providing sensing data for a control system or control unit of a drilling arrangement. The sensing device may be mounted to the casing of the apparatus, or directly to the switch. The sensing device may provide the control unit with data on pressure, temperature, and accelerations, for example. There may be wired or wireless data communication connection between the apparatus inside the drill hole and the control unit outside the drill hole. The gathered monitoring data may be used for controlling operation of the switch and the entire rock drilling system. In other words, there is a feedback system for the control.

According to an embodiment, the switch mounted to the drilling tool comprises at least one sensor or sensing device for providing sensing data for a control system or control unit of a drilling arrangement. The sensing device may provide the control unit with data on pressure, temperature, and accelerations, for example. There may be wired or wireless data communication connection between the switch inside the drill hole and the control unit outside the drill hole. The gathered monitoring data may be used for controlling operation of the switch and the entire rock drilling system. In other words, there is a feedback system for the control.

According to an embodiment, the apparatus comprises mechanical first and second coupling elements, whereby the apparatus is connectable between two drilling components of a rock drilling tool.

According to an embodiment, the apparatus is mountable between a drill head and a drill tube.

According to an embodiment, the apparatus is mountable between two drill tubes.

According to an embodiment, alternatively the apparatus is mountable between two high voltage supply cables.

According to an embodiment, the casing of the apparatus may be part of the drill tube.

According to an embodiment, the casing of the apparatus may be part of the drill head.

According to an embodiment, the switch is integrated to be a constructional part of the drill head, the drill tube or any other drilling component.

According to an embodiment, the drill head is provided with a space or chamber for the switch. The space may provide the switch with a protective shield or structure and to thereby prevent the flushing fluid and drilling cuttings entering to the switch gap. In other words, the drill head may have an integrated pre spark gap for boosting the electro pulses and a main spark gap for detaching the rock material. An advantage of this solution is that the switch is as close to the main spark gap as possible whereby the boosted electro pulses with the high rise time are led directly to the main spark gap. Furthermore, the switch is well protected when it is integrated to the drill head. The space may be formed directly to a body of the drill head, or alternatively it may be a separate piece which is mounted to the body of the drill head.

According to an embodiment, the chamber of the apparatus surrounding the switch is made of dielectric material. The material may be for example plastic material or composite material.

According to an embodiment, the chamber of the apparatus surrounding the switch may be a tubular element provided with opposing end pieces.

According to an embodiment, the apparatus is located on central axis of the drilling tool.

According to an embodiment, the apparatus is located eccentrically relative to drilling axis of a drilling tool so that the apparatus is positioned at an opposite side relative to a ground connector on a same cross sectional plane of view.

According to an embodiment, the solution relates to a drilling arrangement for high voltage electro pulse rock drilling. The drilling arrangement comprises: a drilling tool comprising at least one drill tube and a drill head connected to a distal end of the drill tube; a feed device for feeding the drilling tool in a drilling direction and in a return direction; a flushing device for feeding flushing fluid to the drill head; a pulse generator for generating high voltage electrical pulses; first conductors for conducting the generated high voltage electrical pulses to at least one high voltage electrode which is located on a face surface of the drill head, and second conductors for providing a ground potential for at least one ground electrode which is located on the face surface of the drill head; and wherein high voltage electrical pulses are transmitted from the high voltage electrode to the ground electrode via the rock material thereby breaking the rock material. Further, the drilling tool is provided with at least one switch comprising the features and embodiments disclosed in this document.

According to an embodiment, the flushing fluid is fed inside the one or more drill tubes to the drill head. The switch may then be protected from the flow of the flushing fluid flowing towards the drill head.

According to an embodiment, the flushing fluid is fed outside the one or more drill tubes to the drill head and is fed in reverse direction inside the drill tube. This is known as a reverse circulation drilling (RC-drilling), and the disclosed solution can also be implemented in the RC-drilling. The switch may then be protected from the returning flow of the flushing fluid.

According to an embodiment, the mentioned high voltage pulses has at least 100 kV value of voltage. In tests it has been shown that this 100 kV is the minimum where rock destruction occurs properly and in effective manner.

According to an embodiment, the mentioned high voltage pulses are generated in a Marx generator which may generate pulses voltage of which may be up to 450 kV.

According to an embodiment, frequency of the electro pulses is set by the pulse generator and the spark gap arranged in connection with the drilling tool ensure that the pulses have rise time which is fast enough for breaking and disintegrating the rock material.

According to an embodiment, the switch may be without the hermetically sealed chamber in case penetration of the flushing fluid to the spark gap is prevented in any other manner.

According to an embodiment, the disclosed solution may also relate to a drilling tool, or to a drilling tool component provided with the disclosed switch gap, or pre spark gap, and designed for the high voltage electro drilling.

According to an embodiment, the disclosed solution may also relate to a drill tube provided with the disclosed switch gap, or pre spark gap, and designed for the high voltage electro drilling. The switch may be integrated to be a structural part of the drill tube or it may be mounted immovably to the drill tube.

According to an embodiment, the disclosed solution may also relate to a drill head provided with the disclosed switch gap, or pre spark gap, and designed for the high voltage electro drilling. The drill head comprises a body inside which is a space or chamber for the two electrodes forming the switch gap. The space or chamber provides the switch gap with protection against the flushing fluid. The drill head further comprises at least one high voltage electrode and at least one ground electrode on a face surface intended to face towards the rock to be drilled.

According to an embodiment, the high voltage electro pulses can be led to drill head by means of high voltage cables or other conductors. Thereby the supply line may comprise bendable cables or may alternatively be formed of rigid bars or elements. Further, the cables or bars may be supported to drill tubes and be part of their structure.

According to an embodiment, the disclosed solution is designed for and utilized in drilling small diameter drill holes being one of the following: blast holes, exploration holes, rock bolt holes, injection holes.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
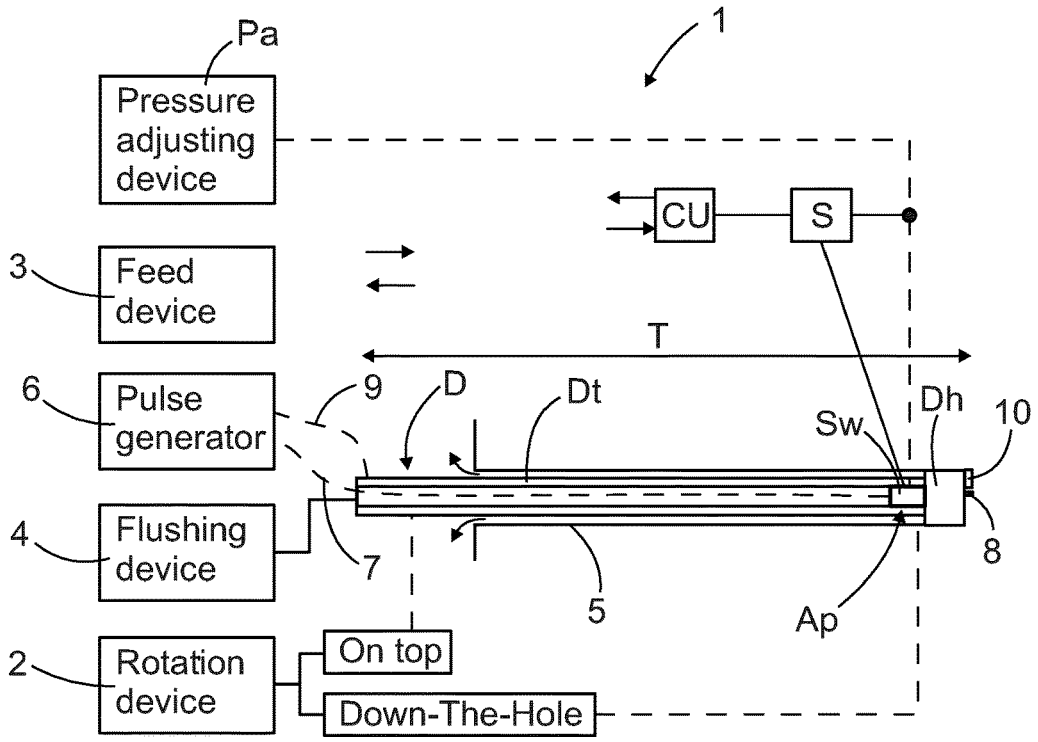
FIG. 1 is a schematic side view of a rock drilling arrangement provided with means for high voltage electro pulse drilling.

FIG. 1 discloses a drilling arrangement 1 provided with a drilling tool D comprising at least one drill tube Dt and a drill head Dh connected to a distal end of the drill tube Dt.

The drilling tool D may comprise one single rigid tubular element, or several rigid extension tubes connected to each other. One alternative is that the drill tube Dt is a flexible tube that can be wound on a reel and can be straightened when being fed inside a drill hole 5. Length T of the drilling tool D may be several meters. There may be a rotating device 2 for rotating at least the drill head Dh around a rotation axis during drilling. The rotating device 2 may be top mounted and turns the entire drilling tool D, or alternative it may be of a down the hole type device and may be arranged to turn only the drill head Dh. A feed device 3 is arranged to feed the drilling tool D in a drilling direction and in a return direction. A flushing device 4 is for feeding flushing fluid to the drill head Dh so that drilling cuttings can be removed from the drill hole 5. The drilling is based on high voltage electrical pulses which are generated in a pulse generator 6 and are transmitted by means of high voltage supply system to the drill head Dh which is located at a bottom of the drill hole 5. There are first conductors 7, such as cables, for conducting the generated high voltage electrical pulses to at least one high voltage electrode 8 which is located on a face surface of the drill head Dh, and second conductors 9 for providing a ground potential for at least one ground electrode 10 which is also located on the face surface of the drill head Dh. The generated high voltage electrical pulses are transmitted from the high voltage electrode 8 to the ground electrode 10 via the rock material thereby breaking the rock material. The drill tube Dt is made of metallic material and can serve as the ground conductor. During the drilling process the flushing fluid flows inside the drilling tube Dt. Depending on the implemented drilling method, the flushing fluid flows inside the drill tube either towards the bottom of the drill hole 5 or towards an opening of the drill hole 5.

The drilling tool D comprises a switch Sw for enchasing the high voltage electro pulses before they reach the electrodes 8, 10 of the drill head Dh. The switch Sw is in accordance with the features and embodiments disclosed in this document, and it can be mounted to several alternative locations in connection with the drilling tool D. The switch Sw is needed at the end portion of the drilling tool because distance from the pulse generator 6 to the drill head Dh may be long. The pulse generator 6 is located outside the drill hole 5.

The arrangement 1 may further comprise a pressure adjusting device Pa for adjusting pressure prevailing in a switch gap of the switch Sw. There may also be one or more sensors S for monitoring operation of the switch Sw and to provide a control unit CU with valuable sensing data. The sensor S may be a pressure sensor or a temperature sensor, for example. The control unit CU may control not only the pressure adjusting device but also other devices and actuators of the arrangement 1.

Figure 2:
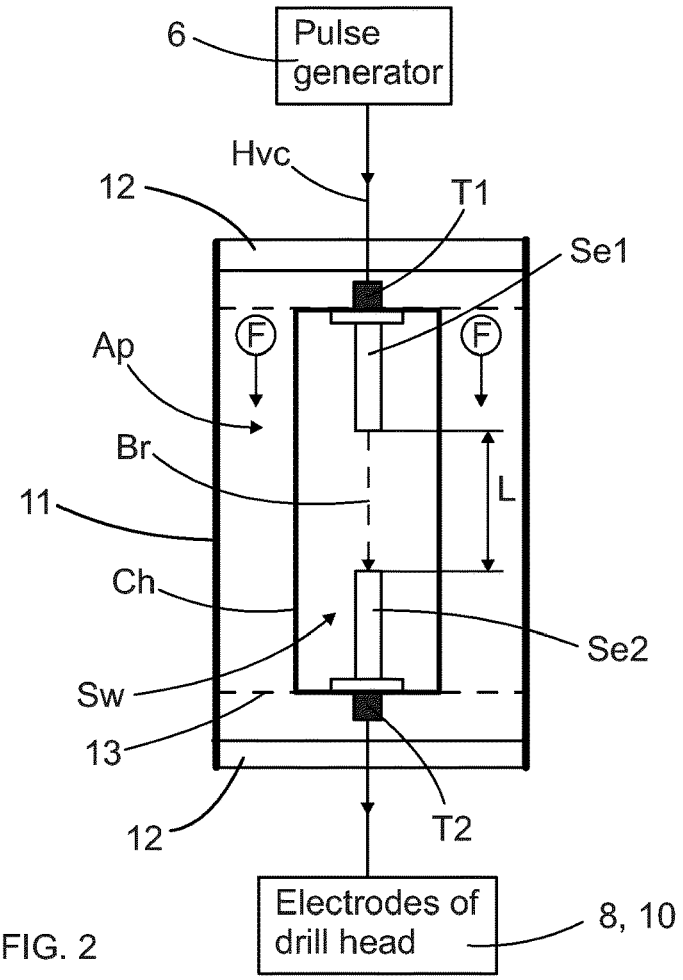
FIG. 2 is a schematic side view of a switch being electrically connected to a supply line of a high voltage pulse system.

FIG. 2 discloses an apparatus Ap mounted to a high voltage cable or conductor Hvc which connects a pulse generator 6 electrically to electrodes 8, 10 of a drill head. The apparatus Ap comprises a switch Sw provided with two opposing electrodes Se1 and Se2 located at a distance L from each other so that there is a switch gap Sg between them. There are a first terminal T1 and second terminal T2 for connecting the switch Sw to the high voltage conductor Hvc. The switch Sw may surrounded by a chamber Ch. The chamber Ch may be hermetically sealed so that flushing fluid F flowing inside a drilling tool cannot penetrate to the switch gap Sg and to prevent intended operation of the switch Sw.

The electrode Se1 is connected to the cable Hvc. When reaching the adjusted or wanted value of impulse voltage a breakdown Br occurs between Se1 and Se2. Se2 is connected to an active electrode of the drill head. The discharge creates a conductive path that connects the cable to the drill head. Through switching the impulse is accelerated and the energy of the impulse is transferred to the drill head. The distance L between the Se1 and Se2 and the pressure inside the chamber Ch defines the switching voltage of the switch gap Sg. Se1 and Se2 may be mounted in that way, that the discharge only occurs on their surfaces which are directly facing each other.

FIG. 2 further discloses that the apparatus Ap may be mounted to a separate tubular element 11, which may be provided with coupling elements 12, such as coupling screws, for mounting the disclosed structure between two drill tubes or between a drill tube and a drill head. There may be support elements 13 for supporting the apparatus Ap to the element 11.

Figure 3:
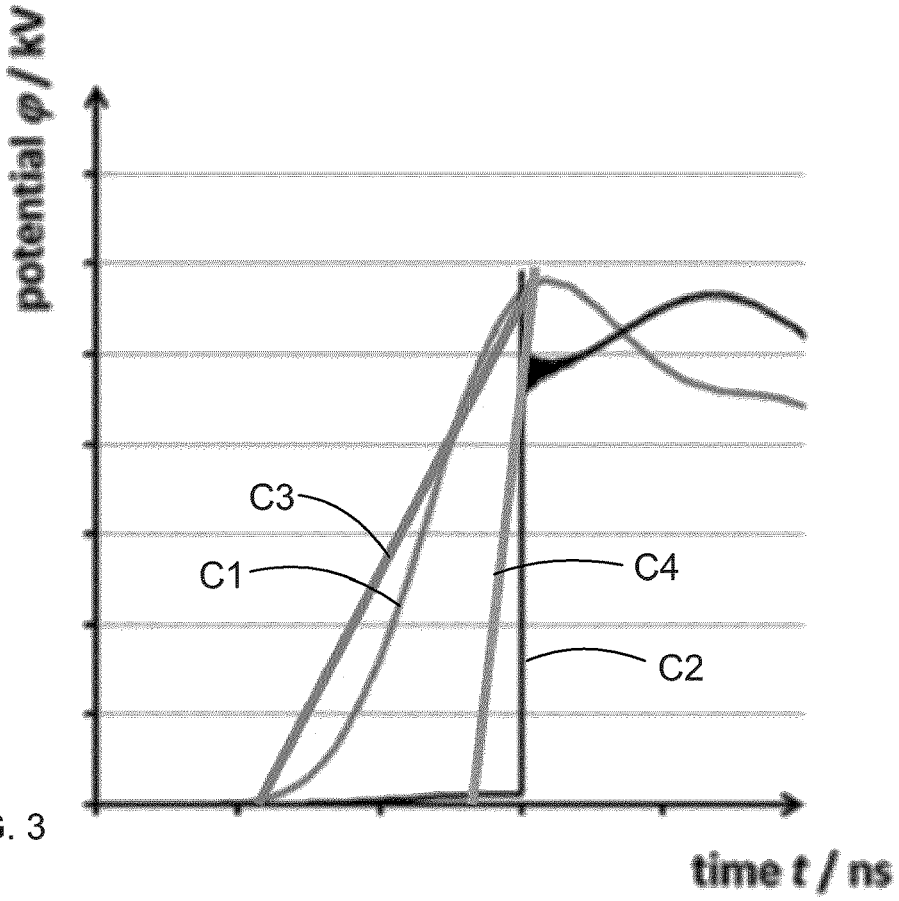
FIG. 3 is a schematic graph illustrating fast rise time achieved by means of a pre spark gap arranged to a drilling tool.

FIG. 3 illustrates effect of the switch gap. A curve C1 shows a situation when the switch in connection with a drilling tool is not implemented. As can be seen shape of an impulse on the electrodes has low and insufficient rise time. A curve C2 shows a situation when the switch is implemented. Then shape of the impulse on the electrode has quick rise time and is thereby capable of breaking rock material. FIG. 3 further discloses straight lines C3 and C4 for illustrating differences of steepness of the impulses in the compared two situations. By examining the lines C3 and C4 and their slopes, it is clear the switch causes a shorter risetime.

Figure 4:
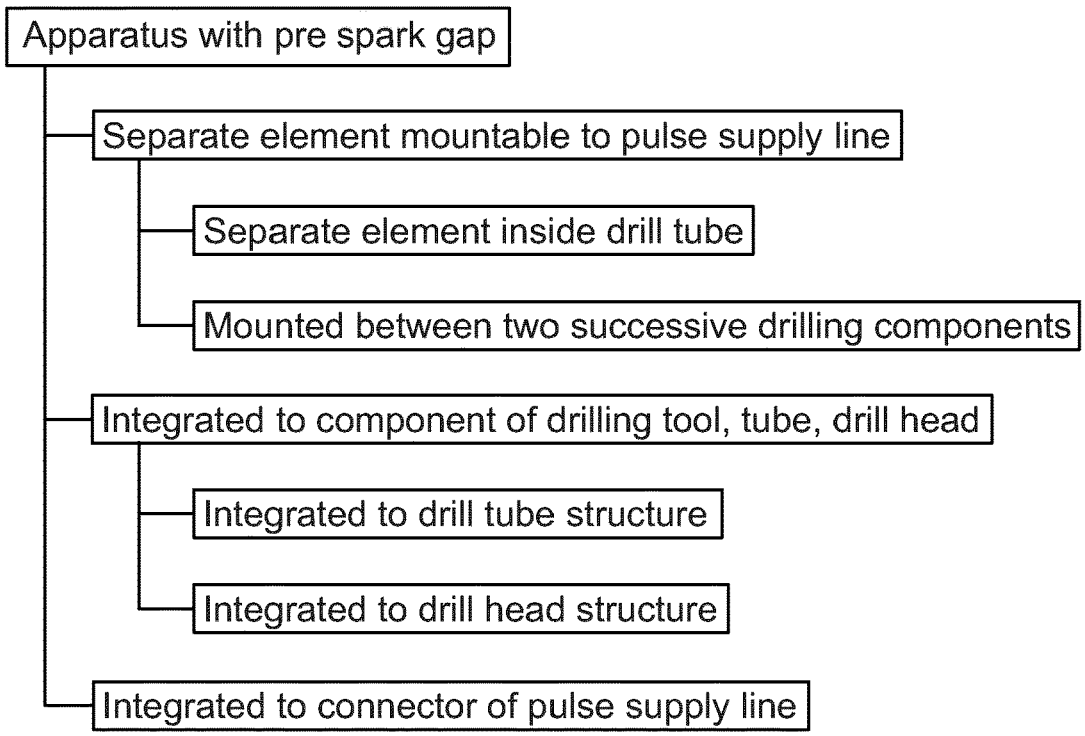
FIG. 4 is a schematic diagram presenting some alternativities for providing a drilling tool with a pre spark gap.

FIG. 4 discloses some possible mounting alternatives for the disclosed apparatus in connection with a drilling tool and its different components. The features presented in FIG. 4 have already been discussed above in this document and at least some of them will be discussed in more detailed below.

Figure 5:
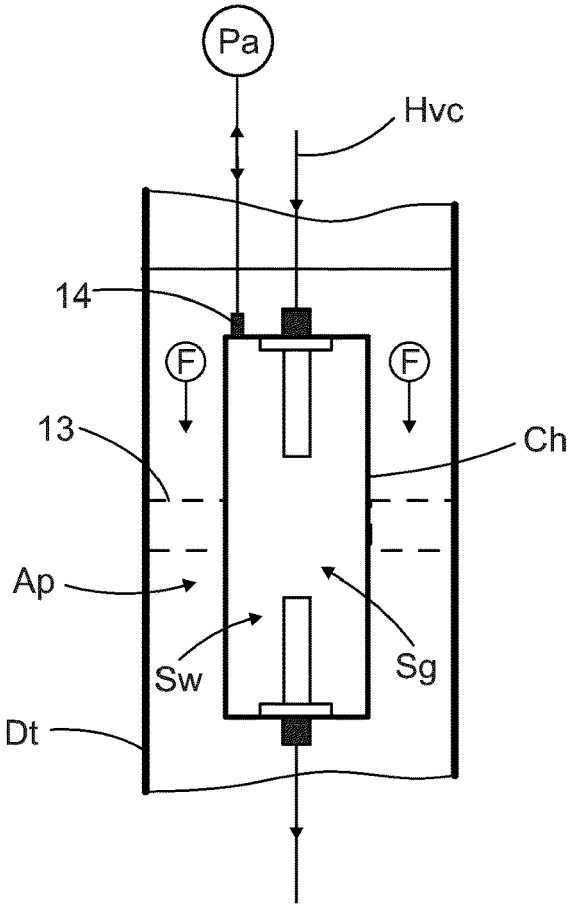
FIG. 5 is a schematic side view of a switch arranged inside a drill tube.

FIG. 5 discloses an apparatus Ap comprising a switch Sw which may be in accordance with the features disclosed in this document. The switch Sw may be mounted inside a chamber Ch, or alternative only a switch gap Sg is surrounded by the chamber. The chamber Ch may be supported against inner surfaces of a drill tube Dt by means of mechanical support elements 13, such as ring shape pieces, bars, or protrusions. Purpose of the support elements 13 is to keep the apparatus Ap immovably connected.

The chamber Ch may be sealed so that it can keep the flushing fluid F out of the switch gap Sg. The chamber may also be pressurized with gas. Further, the apparatus Ap may comprise a feed port 14 for adjusting gas pressure prevailing inside the chamber Ch by means of a pressure adjusting device Pa.

Figure 6:
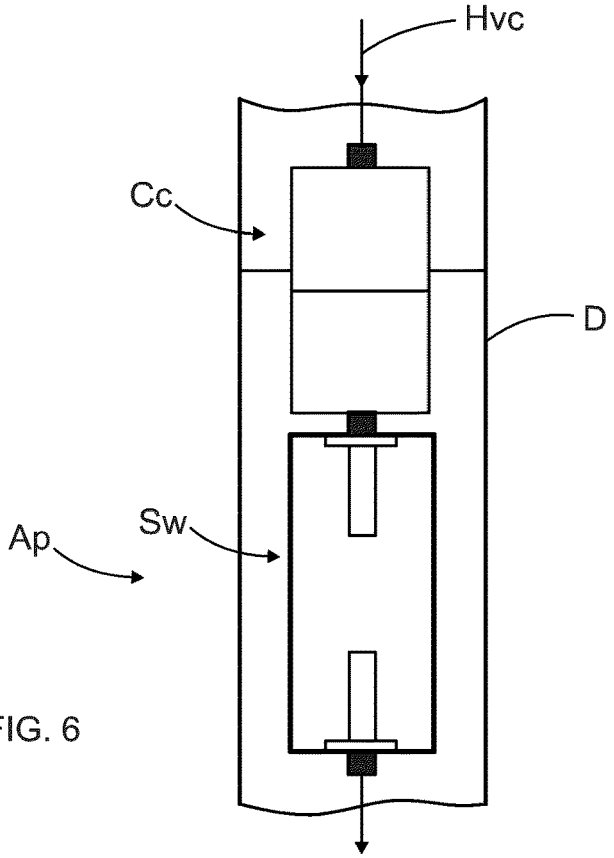
FIG. 6 is a schematic side view of a switch arranged in connection with a coupling element of a high voltage connector.

FIG. 6 discloses an arrangement wherein the apparatus Ap disclosed in this document is arranged in connection with a high voltage connecting element or cable connector Cc.

Figure 7:
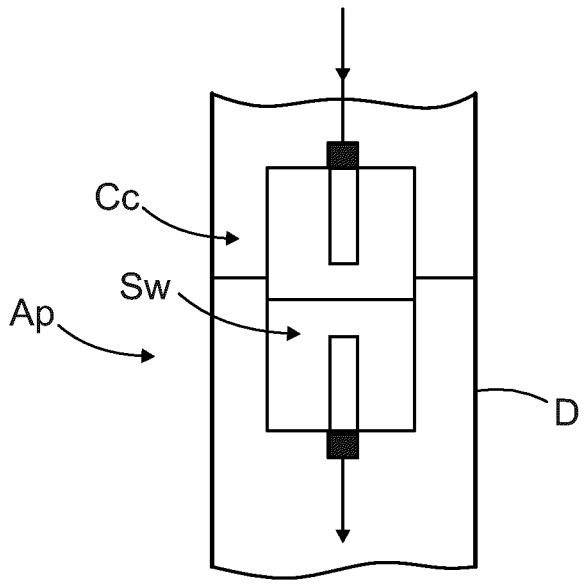
FIG. 7 is a schematic side view of a switch serving also as a coupling element between two successive components of a drilling tool.

FIG. 7 discloses an embodiment wherein an apparatus Ap is a dual purpose element serving both as a switch and a cable connecting element Cc. This kind of apparatus Ap can be mounted between two components of a drilling tool D, and there is no need for separate a switch and a connector.

Figure 8:
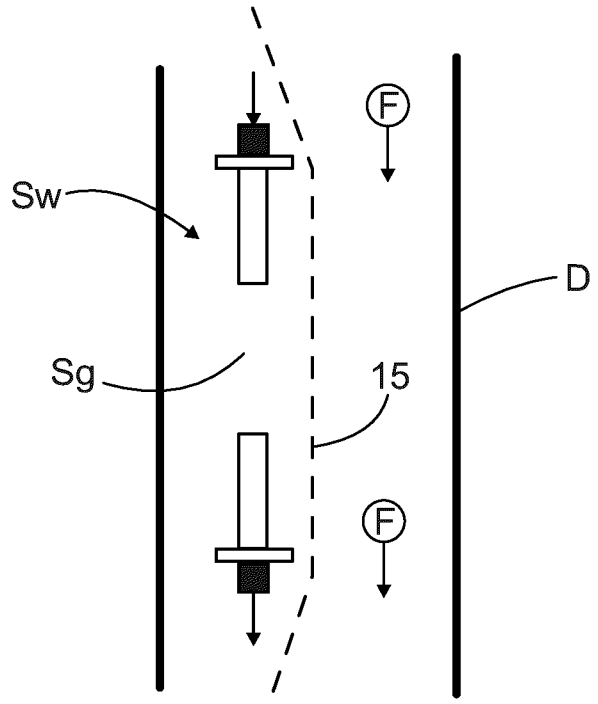
FIG. 8 is a schematic and simplified side view of a switch arranged in connection with a drilling tool so that flushing fluid may not penetrate to a pre spark gap of the switch.

FIG. 8 is a highly simplified illustration of an embodiment, wherein a switch Sw is not surrounded by a chamber connected to the switch. Instead, flow of flushing fluid F is directed by means of shielding surfaces 15 or structures so that a switch gap Sg is not suffered from the flushing fluid F. The switch Sw may be inside a structure of a drilling tool D and the flow of the flushing fluid F may pass the switch Sw.

Figure 9:
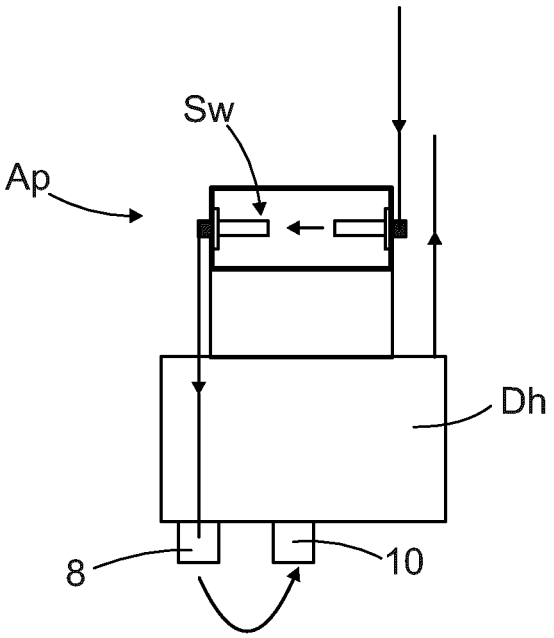
FIG. 9 is a schematic side view of a drill head provided with a switch.

FIG. 9 discloses a drill head Dh provided with an apparatus Ap, which is in accordance with the features disclosed in this document. The apparatus Ap may be a separate structure mounted to the drill head Dh, or it alternatively be integrated to be an inseparable component of the drill head Dh.

Figure 10:
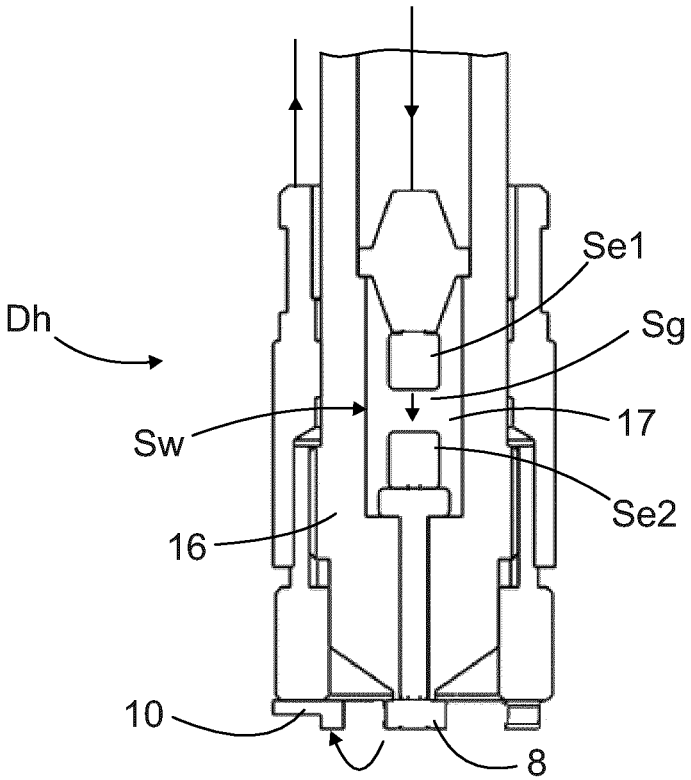
FIG. 10 is a schematic side view of a drill head comprising a switch integrated inside a structure.

FIG. 10 discloses a drill head Dh body 16 of which is provided with a space 17 for a switch Sw. The space 17 may be separated from flushing fluid flowing through the drill head Dh. There may be dedicated channels for the passing fluid flow path in the drill head Dh. Furthermore, the space 17 may be sealed and it may comprise a feed port for feeding pressurized gas inside the space or forming a vacuum therein.

The drawings and the related description are only intended to illustrate the idea of the invention. In its details, the invention may vary within the scope of the claims.

The invention claimed is:

1. An apparatus for electro pulse rock drilling wherein drill holes are formed by means of high voltage electro pulses conveyed through rock material, wherein the apparatus comprises:

a switch provided with two opposing electrodes located at a distance from each other so that there is a switch gap between them;

a first terminal and second terminal arranged for connecting the switch to a high voltage conductor;

at least one mechanical element arranged for supporting the apparatus to a rock drilling tool;

a hermetically sealed chamber surrounding the switch, wherein the sealed chamber is pressurized with gas; and at least one feed port arranged for adjusting gas pressure prevailing inside the chamber.

2. The apparatus as claimed in claim 1, wherein the distance between the two opposing electrodes is adjustable for adjusting magnitude of the switch gap.

3. The apparatus as claimed in claim 1, further comprising mechanical first and second coupling elements, whereby the apparatus is connectable between two drilling components of a rock drilling tool.

4. The apparatus as claimed in claim 1, wherein the apparatus is part of a drill head of the drilling tool.

5. The apparatus as claimed in claim 1, wherein the chamber of the apparatus is made of dielectric material.

6. A drilling arrangement for high voltage electro pulse rock drilling, wherein the arrangement comprises:

a drilling tool including at least one drill tube and a drill head connected to a distal end of the drill tube;

a feed device arranged for feeding the drilling tool in a drilling direction and in a return direction;

a flushing device arranged for feeding flushing fluid to the drill head;

a pulse generator arranged for generating high voltage electrical pulses;

first conductors arranged for conducting the generated high voltage electrical pulses to at least one high voltage electrode which is located on a face surface of the drill head;

second conductors arranged for providing a ground potential for at least one ground electrode, which is located on the face surface of the drill head, wherein high voltage electrical pulses are transmitted from the at least one high voltage electrode to the at least one ground electrode via the rock material thereby breaking the rock material; and the drilling tool being provided with at least one apparatus according to claim 1.

7. The arrangement as claimed in claim 6, wherein the drill head is provided with a space for the switch of the apparatus, whereby the space serves as the chamber for shielding the switch gap from the flushing fluid.

8. A method for high voltage electro pulse drilling of rock, wherein the method comprises:

generating high voltage electrical pulses by means of at least one pulse generator;

executing the drilling by means of a drilling tool including at least one drill tube and a drill head connected to a distal end of the drill tube;

feeding the drilling tool in a drilling direction during the drilling;

feeding flushing fluid to the drill head for flushing removed rock material;

conducting the generated high voltage electrical pulses to at least one high voltage electrode on the drill head;

providing ground potential for at least one ground electrode on the drill head;

breaking the rock by transmitting the high voltage electrical pulses from the high voltage electrode to the ground electrode via the rock material;

generating the high voltage electrical pulses outside a drill hole to be drilled;

providing the ground potential via the at least one drill tube;

conducting the generated high voltage electrical pulses inside the at least one drill tube by means of a high voltage supply line;

connecting the high voltage supply line to at least one switch, which is located in connection with the drilling tool;

enhancing the high voltage electro pulses in the drilling tool by accelerating rise time of the pulses by means of a switch gap which is disposed between two opposing electrodes of the switch; and preventing the flushing fluid flow from entering to the switch gap.

9. The method as claimed in claim 8, further comprising:

monitoring operation of the switch by means of at least one sensor;

transmitting the monitoring data from the sensor to at least one control unit; and adjusting pressure prevailing in the switch gap under control of the control unit and in response to the gathered monitoring data.

10. The method as claimed in claim 8, comprising using liquiform flushing fluid.

11. The method as claimed in claim 8, further comprising allowing a distance between the pulse generator and the switch to be several meters during the drilling.

* * * * *